US011981401B2

(12) United States Patent
Cooper et al.

(10) Patent No.: US 11,981,401 B2
(45) Date of Patent: May 14, 2024

(54) MODULAR INFLATABLE PLATFORM SYSTEM

(71) Applicant: BOTE, LLC, Miramar Beach, FL (US)

(72) Inventors: Corey Cooper, Destin, FL (US); Aaron May, Parker, CO (US)

(73) Assignee: BOTE, LLC, Miramar Beach, FL (US)

( * ) Notice: Subject to any disclaimer, the term of this patent is extended or adjusted under 35 U.S.C. 154(b) by 93 days.

(21) Appl. No.: 17/661,726

(22) Filed: May 2, 2022

(65) Prior Publication Data

US 2022/0258840 A1 Aug. 18, 2022

Related U.S. Application Data

(63) Continuation-in-part of application No. 29/790,858, filed on Dec. 17, 2021, and a continuation-in-part of application No. 29/790,861, filed on Dec. 17, 2021, and a continuation-in-part of application No. 29/790,864, filed on Dec. 17, 2021, and a continuation-in-part of application No. 29/790,871, filed on Dec. 17, 2021, and a continuation-in-part of application No. 29/790,860, filed on Dec. 17, 2021, and a continuation-in-part of application No. 29/790,857, filed on Dec. 17, 2021, now Pat. No. Des. 968,547, and a continuation-in-part of application No. 29/790,862, filed on Dec. 17, 2021, and a continuation-in-part of application No. 29/790,863, filed on Dec. 17, 2021, now Pat. No. Des. 995,682, and a continuation-in-part of application No. 29/790,859, filed on Dec. 17, 2021, and a continuation-in-part of application No. 17/443,504, filed on Jul. 27, 2021, now abandoned, and a continuation-in-part of application No. 17/350,845, filed on Jun. 17, 2021, and a continuation-in-part of application No. 29/786,720, filed on Jun. 2, 2021, now Pat. No. Des. 982,699, and a continuation-in-part of application No. 17/165,337, filed on Feb. 2, 2021, now Pat. No. 11,685,480, and a continuation-in-part of application No. 17/033,067, filed on Sep. 25, 2020.

(51) Int. Cl.
*B63B 34/52* (2020.01)
*B63B 34/565* (2020.01)

(52) U.S. Cl.
CPC ..... *B63B 34/52* (2020.02); *B63B 34/565* (2020.02)

(58) Field of Classification Search
CPC ..... B63B 34/52; B63B 34/565; B63B 3/08; B63B 7/085; B63B 35/58
USPC ..... 248/206.5
See application file for complete search history.

(56) References Cited

U.S. PATENT DOCUMENTS 3,021,536 A * 2/1962 Haggerty ..... B63B 7/08 441/40
4,662,852 A * 5/1987 Schneider ..... A47C 15/006 297/452.13

(Continued)

*Primary Examiner* — Nkeisha Smith
(74) *Attorney, Agent, or Firm* — Talus Law Group LLC

(57) ABSTRACT

The present invention is directed to an inflatable and floatable modular platform system. The inflatable platform system of the present disclosure includes floating elements of differing nesting shapes and sizes configured to be interconnected in order to allow users to stand, sit, and walk between floating elements. Embodiments include inflatable platforms having circular, arc-shaped, rectangular, and L-shaped inflatable platforms.

14 Claims, 8 Drawing Sheets

(56) References Cited

U.S. PATENT DOCUMENTS

| | | | | |
|---|---|---|---|---|
| 5,483,914 | A * | 1/1996 | Wonka | B63B 3/08 114/345 |
| 5,507,674 | A * | 4/1996 | Yeung | B63B 34/52 441/131 |
| 6,053,790 | A * | 4/2000 | Langford | B63B 35/58 114/248 |
| 7,137,856 | B2 * | 11/2006 | Zheng | B63B 34/52 441/131 |
| 7,867,049 | B1 * | 1/2011 | Doffay | B63B 35/58 441/40 |
| 8,702,461 | B1 * | 4/2014 | d'Offay | B63B 34/52 441/40 |
| 9,039,472 | B2 * | 5/2015 | Whitehead | B63B 21/00 441/35 |
| 9,067,651 | B1 * | 6/2015 | Peterson | B63B 34/52 |
| 9,376,777 | B2 * | 6/2016 | Peterson | B63B 34/52 |
| 10,357,112 | B2 * | 7/2019 | Zheng | A47C 15/006 |
| 10,420,424 | B1 * | 9/2019 | Perry | A47C 15/006 |
| 11,148,765 | B2 * | 10/2021 | Pieschel | B63B 34/54 |
| 2013/0267135 | A1 * | 10/2013 | Berenson | A63B 69/14 441/132 |
| 2022/0273106 | A1 * | 9/2022 | Cooper | A47C 15/006 |
| 2023/0257077 | A1 * | 8/2023 | Jacobson | B63B 35/44 441/136 |

* cited by examiner

SECTION A-A
SCALE 1:10

MODULAR INFLATABLE PLATFORM SYSTEM

CROSS REFERENCE TO RELATED APPLICATIONS

This application claims the benefit of U.S. patent application Ser. No. 17/443,504 entitled MAGNETIC CONNECTION APPARATUS and filed on Jul. 27, 2021, U.S. patent application Ser. No. 17/350,845 entitled MAGNETIC DRINKWARE and filed on Jun. 17, 2021, U.S. patent application Ser. No. 17/165,337 entitled DROP STITCH INFLATABLE SEAT and filed Feb. 2, 2021, U.S. patent application Ser. No. 17/033,067 entitled MAGNETIC ACCESSORY SURFACE MOUNT and filed on Sep. 25, 2020, U.S. patent application Ser. No. 29/786,720 entitled INFLATABLE DOCK and filed on Jun. 2, 2021, U.S. patent application Ser. No. 29/790,858 entitled INFLATABLE CHAIR and filed on Dec. 17, 2021, U.S. patent application Ser. No. 29/790,871 entitled INFLATABLE LOUNGE and filed on Dec. 17, 2021, U.S. patent application Ser. No. 29/790,857 entitled INFLATABLE DOCK and filed on Dec. 17, 2021, U.S. patent application Ser. No. 29/790,859 entitled INFLATABLE DOCK and filed on Dec. 17, 2021, U.S. patent application Ser. No. 29/790,860 entitled INFLATABLE DOCK and filed on Dec. 17, 2021, U.S. patent application Ser. No. 29/790,861 entitled INFLATABLE DOCK and filed on Dec. 17, 2021, U.S. patent application Ser. No. 29/790,862 entitled INFLATABLE DOCK and filed on Dec. 17, 2021, U.S. patent application Ser. No. 29/790,863 entitled INFLATABLE DOCK and filed on Dec. 17, 2021, and U.S. patent application Ser. No. 29/790,864 entitled INFLATABLE DOCK and filed on Dec. 17, 2021, the entire contents of each of which are incorporated herein by reference in their entirety for all purposes.

FIELD OF THE INVENTION

The present invention is directed to an inflatable and floatable modular platform system. The inflatable platform system of the present disclosure includes floating elements of differing shapes and sizes configured to be interconnected in order to allow users to stand, sit, and walk between floating elements.

BACKGROUND OF THE INVENTION

Inflatable furniture and inflatable products, referred herein as inflatables, devised for outdoor recreation provide a buoyancy to keep users partially or entirely above the surface of the water on which they are deployed.

Traditional inflatables have been limited to spherical and cylindrical elements, including products such as rafts which relied upon adjoined cylindrical chambers which dictate the external form of the inflatable. Recent developments in technology, such as drop-stitch construction, enable the ability to manufacture inflatables in planar surfaces, i.e., with opposing surfaces substantially parallel to one another, and other non-planar forms which do not rely upon cylindrically shaped chambers.

Inflatable furniture has traditionally been limited to individual units such as a raft, chair, or other unit, wherein the inflatable unit is used independently of other inflatable units. When multiple units are used in concert, maintaining proximity to other inflatable units to maintain a safe buoyant environment and socially conducive distance is challenging. Thus, a need for a modular inflatable platform system of interconnectable inflatable units has been identified, wherein each unit is configured to be used as an individual unit, and can be alternatively used modularly when interconnected with other inflatable units to produce a configurable system.

SUMMARY OF THE INVENTION

It is an aspect of the present invention to provide a system of modularly interconnectable inflatable platforms wherein each inflatable platform is individually usable as a floating platform, or interconnectable with other inflatable platforms.

It is an aspect of certain embodiments of the present invention to provide a modular inflatable platform system comprising an inflatable platform wherein the inflatable platform comprises a recess for receiving a cooler, wherein the cooler is configured to keep beverages and other food items cool. The recess of the inflatable platform constrains the cooler therein to provide buoyancy and to prevent the tipping of the inflatable platform. Furthermore, placing the cooler within the recess allows the cooler to rest on a surface below the top surface of the inflatable platform resulting in a system having a lower center of gravity than a configuration of the cooler placed on the top surface of the inflatable platform.

It is an aspect of certain embodiments of the present invention to provide a modular inflatable platform system which comprises a first inflatable platform and a second inflatable platform, wherein the inflatable platforms are interconnectable to result in a system of inflatable platforms. The inflatable platforms each comprise at least one interconnection point located proximal to the perimeter of the inflatable platforms, or upon a top surface of the inflatable platform. In certain embodiments the inflatable platforms comprise interconnection points in the form of interconnection points comprising a D-Ring, shackle, or other interconnection points configured to receiving a tether therethrough for interconnection of the first inflatable platform and the second inflatable platform.

It is an aspect of certain embodiments of the present invention to provide at least one handle interconnected with a top surface of an inflatable platform. Alternate embodiments comprising handles interconnected with a side of an inflatable platform are within the spirit and scope of the present invention.

It is an aspect of certain embodiments of the present invention to provide inflatable platforms which are configured to be interconnected wherein the first inflatable platform and the second inflatable platform are constrained to prevent relative movement between the first inflatable platform and the second inflatable platform. In certain embodiments, the interconnection between the first inflatable platform and the second inflatable platform comprises at least one tensile element spanning between the first inflatable platform and the second inflatable platform. Certain embodiments employ at least two points of contact between a first inflatable platform and a second inflatable platform, wherein an external perimeter of a first inflatable platform is interconnected with an internal perimetral aspect of a second inflatable platform. As discussed herein, perimetral aspects such as a convex elements, and reflex angles are considered external perimetral aspects for the purposes of the present application. Furthermore, perimetral aspects such as concave elements, and internal angles are considered internal perimetral aspects for the purposes of the present application.

Certain embodiments of the present invention comprise a first inflatable platform comprising an external perimetral aspect, and a second inflatable platform comprising an internal perimetral aspect. The external perimetral aspect and the internal perimetral aspect are similarly shaped wherein the external perimetral aspect of the first inflatable platform is configured to be received by the internal perimetral aspect of the second inflatable platform, resulting in a substantially continuous nesting contact between the first inflatable platform and the second inflatable platform.

It is an aspect of certain embodiments of the present invention to provide inflatable platforms which are configured to be interconnected wherein the first inflatable platform and the second inflatable platform are constrained to prevent relative movement between the first inflatable platform and the second inflatable platform. In certain embodiments the interconnection between the first inflatable platform and the second inflatable platform comprises two tensile elements spanning between the first inflatable platform and the second inflatable platform. For example, a first linear perimetral aspect of the first inflatable platform is abutted with a first linear perimetral aspect of the second inflatable platform, wherein each inflatable platform comprises a first interconnection point and a second interconnection point, wherein the interconnection points of the inflatable platforms are configured to align with each other when the linear perimetral aspects of the inflatable platforms are abutted.

The interconnection of inflatable platforms resulting in the constraint of the inflatable platforms in relation to each other, by interconnection points and/or substantially continuous nesting contact, allows users to enjoy a modular inflatable platform system wherein users can lay, sit, or walk along and between the interconnected inflatable platforms. The interconnection of the inflatable platforms to each other results in a more stable inflatable platform system which increases safety and allows for increased social interaction without the need for continual adjusting of inflatable platforms in relation to each other.

It is an aspect of certain embodiments of the present invention to secure and interconnect beverages and other personal items to the top surface of an inflatable platform using magnetic apparatus. Personal items include, but are not limited to keys, cameras, pocket knives, or other items that have ferrous metal components that are desirably carried by outdoor sportspeople while engaged in fishing, paddling, boating, sailing, and other outdoor sports. Such technologies are disclosed by U.S. patent application Ser. No. 17/350,845 ("the '845 application) and U.S. patent application Ser. No. 17/443,504 ("the '504 application"), both of which are incorporated by reference in their entirety for all purposes herein.

Certain embodiments comprise an inflatable platform comprising an inflatable bolster or backrest which is configured to assist a user in laying or sitting upon the top surface of the inflatable platform. In certain embodiments a bolster comprises a circular cross-section inflatable device interconnected with a top surface allowing a user to lean against or rest their head upon the bolster. In certain embodiments a back rest comprises an inflatable panel hingedly interconnected to a top surface of the inflatable platform, thus allowing a user to configure the back rest between 0-degrees and 180-degrees from the top surface of the inflatable platform. Apparatus for connecting the bolster or backrest to the inflatable platform are disclosed by U.S. patent application Ser. No. 17/165,337 ("the '337 application"), which is incorporated by reference in its entirety for all purposes herein.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Certain embodiments, as shown in FIG. 1A-FIG. 1E for example, of the present invention comprise an inflatable platform 1000. The inflatable platform 1000 comprises a top surface 1010, a bottom surface 1020, and a perimeter 1050 which defines the shape of the inflatable platform. The bottom surface 1020 of the inflatable platform is intended for direct contact with a body of water. The bottom surface 1020 of the inflatable platform of certain embodiments comprises a planar surface, however embodiments are not limited to having planar bottom surfaces, and alternate embodiments comprising non-planar bottom surface are within the spirit and scope of the present invention. The top surface of 1020 the inflatable platform comprises a planar form configured to allow users to lay, sit, walk, and otherwise interact with the top surface. Alternate embodiments comprising a non-planar top surface are within the spirit and scope of the present invention.

Certain embodiments of the present invention comprise a top surface 1010 and a bottom surface 1020 wherein the top surface 1010 and bottom surface 1020 are interconnected by a plurality of threads, typically polyester, wherein the plurality of threads maintain a thickness 1100 between the top surface 1010 and the bottom surface 1020. This interconnection between the top surface 1010 and the bottom surface 1002 is commonly referred to as drop-stitching. The volume contained between the top surface 1010 and the bottom surface 1020 comprises an air-tight chamber 1150 which is pressurized to inflate the chamber 1150.

Figure 1A:
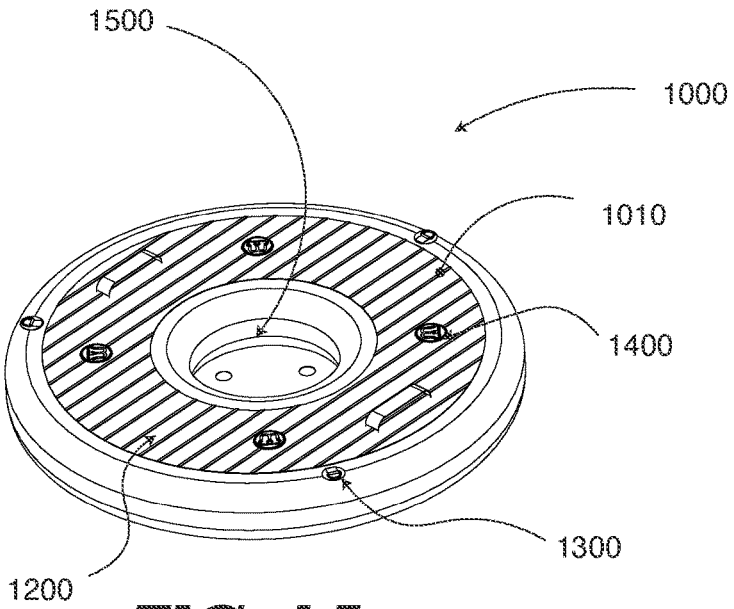
FIG. 1A—A perspective view of certain embodiments comprising an inflatable platform FIG. 1B—A top view of certain embodiments comprising an inflatable platform FIG. 1C—A side view of certain embodiments comprising an inflatable platform FIG. 1D—A cross-sectional view of certain embodiments comprising an inflatable platform as shown in FIG. 1B FIG. 1E—A bottom view of certain embodiments comprising an inflatable platform FIG. 2A—A top view of certain embodiments comprising a first inflatable platform configured to interconnect with a second inflatable platform FIG. 2B—A top view of certain embodiments comprising a plurality of inflatable platforms configured to interconnect with each other FIG. 3A—A top view of certain embodiments comprising an inflatable platform FIG. 3B—A side view of certain embodiments comprising an inflatable platform FIG. 3C—A perspective view of certain embodiments comprising an inflatable platform FIG. 4A—A top view of certain embodiments comprising an inflatable platform FIG. 4B—A side view of certain embodiments comprising an inflatable platform FIG. 4C—A perspective view of certain embodiments comprising an inflatable platform FIG. 5A—A top view of certain embodiments comprising a first inflatable platform configured to interconnect with a second inflatable platform FIG. 5B—A side view of certain embodiments comprising an inflatable platform FIG. 5C—A perspective view of certain embodiments comprising an inflatable platform FIG. 6A—A top view of certain embodiments comprising an inflatable platform FIG. 6B—A side view of certain embodiments comprising an inflatable platform FIG. 6C—A perspective view of certain embodiments comprising an inflatable platform FIG. 7A—A top view of certain embodiments comprising a first inflatable platform configured to interconnect with a second inflatable platform FIG. 7B—A top view of certain embodiments comprising a first inflatable platform configured to interconnect with a second inflatable platform FIG. 7C—A top view of certain embodiments comprising a first inflatable platform configured to interconnect with a second inflatable platform
Figure 1B:
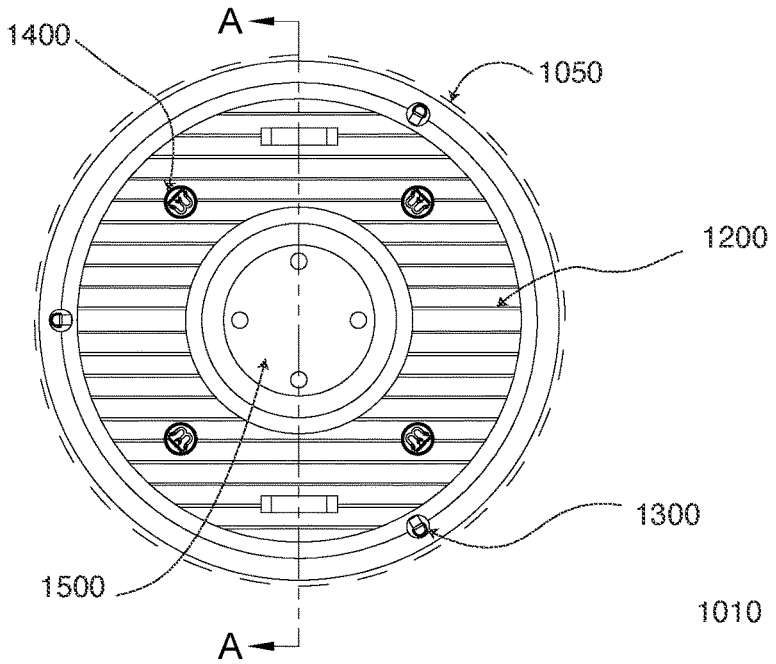
Figure 1C:
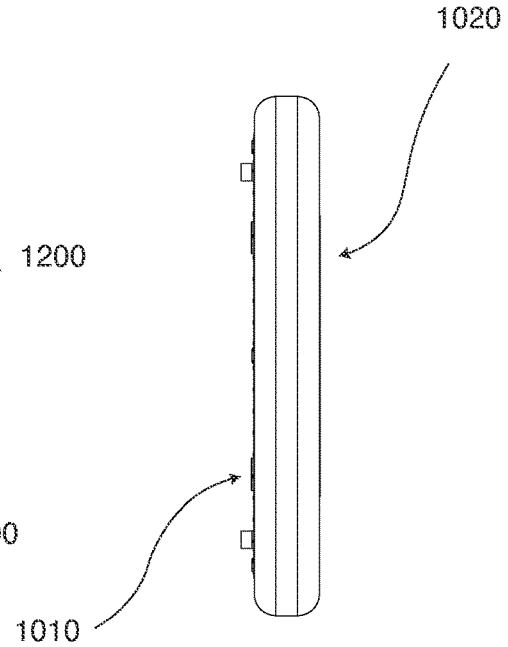
Figure 1D:
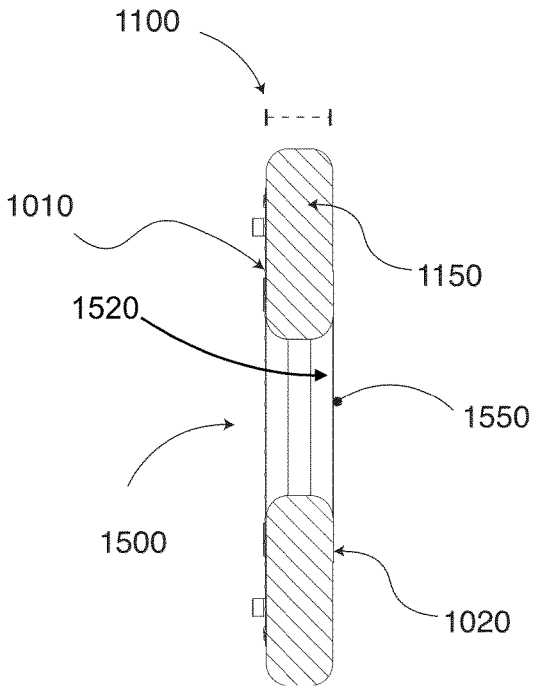
Figure 1E:
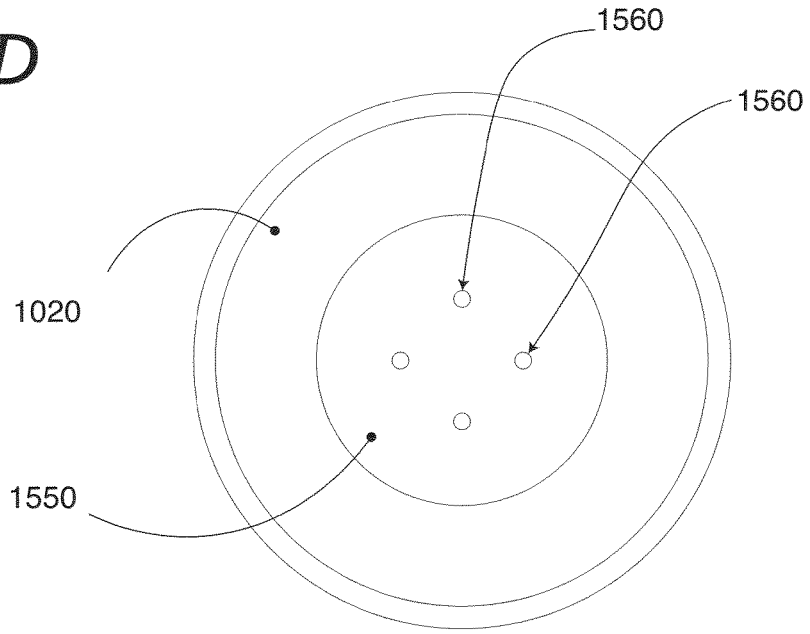

Certain embodiments of the present invention, as shown in FIG. 1A-FIG. 1B for example, comprise an inflatable platform wherein the top surface comprises grip enhancing surface treatment 1200. Grip enhancing surface treatments 1200 include, but are not limited to: texturized coatings, material bonded to the top surface of the inflatable platform, rubberized coatings, surface depth variation, or other materials for enhancing grip known in the existing state of the art.

Certain embodiments of the present invention, as shown in FIG. 1A-FIG. 1B for example, comprise an inflatable platform 1000 comprising at least one interconnection point 1300 interconnected to a top surface 1010 of the inflatable platform. Alternate embodiments comprising an interconnection point 1300 interconnected to the perimeter surface 1050 of the inflatable platform are within the spirit and scope of the present invention. The interconnection point 1300 comprises an aperture wherethrough a tethering device, such as a cord, webbing, bungee, chain, clip, carabiner, or other tensile load carrying device, can be passed to interconnect the inflatable platform to an interconnection point 1300 of a second inflatable platform. Alternate embodiments comprise an interconnection point comprising devices commonly referred to as lashing pots, such as cloverleaf lashing pots which allow lashing with a device commonly referred to as an elephant's foot, or a cleat. Other alternate embodiments comprise an interconnection point comprising a webbing strap and buckle or snap. Alternate embodiments comprising interconnection points known in the state of the art are within the spirit and scope of the present invention.

Certain embodiments comprise an inflatable platform 1000 having a magnetic connection apparatus 1400 configured to receive and interconnect with drinkware and other ferrous objects as disclosed in the '845 application and the '504 application. An inflatable platform of such embodiments comprises at least one magnetic connection apparatus interconnected with the top surface 1010 of the inflatable platform. Certain embodiments comprise an inflatable platform comprising a plurality of magnetic connection apparatus 1300 distributed about the top surface 1010 of the inflatable platform.

Certain embodiments of the present invention comprise an inflatable platform 1000 having a top surface 1010, a bottom surface 1020, and an inflatable chamber 1150 therebetween having a thickness 1100. The inflatable platform 1000 further comprises a recess 1500 offset from a perimeter 1050 of the inflatable platform. The recess 1500 of certain embodiments (FIG. 1B) is located centrally in relation to the perimeter 1050 of the inflatable platform. The recess 1500 extends from the top surface 1010 to the bottom surface of the inflatable platform, wherein the bottom 1520 of the recess comprises a membrane 1550. In certain embodiments, the bottom surface 1020 and membrane 1550 are contiguous. In other embodiments, the membrane 1550 is interconnected to the bottom surface 1020. The bottom of the recess 1500 of certain embodiments is coincident with the bottom surface 1020 of the inflatable platform wherein the depth of the recess is equal to the thickness 1100 of the inflatable platform. In alternate embodiments, the bottom 1020 of the recess is offset from the bottom surface 1020 of the inflatable platform wherein the depth of the recess is less than the thickness 1100 of the inflatable platform or the depth of the recess is more than the thickness 1100 of the inflatable platform. Alternate embodiments wherein the recess 1500 comprises a thru-hole extending from the top surface 1010 of the inflatable platform to the bottom surface 1020 of the inflatable platform are also within the spirit and scope of the present invention. In certain embodiments comprising a recess 1500, the bottom 1520 of the recess comprises at least one aperture 1560 wherein water captured in the recess is permitted to drain from the recess in a process commonly referred to as "self-bailing."

The recess 1500 of certain embodiments, as shown in FIG. 1B for example, comprises a circular form. Alternative embodiments comprise a recess 1500 having a polygonal form, or other shapes as desired, are within the spirit and scope of the present invention. In certain embodiments the recess is configured to receive a cooler, such as disclosed in U.S. Design Pat. No. D812,981 ("the '981 patent") incorporated by reference herein for all purposes, while in alternate embodiments the recess can be configured to receive alternative objects as desired.

Certain embodiments of the present invention, as shown in FIG. 1A-FIG. 1E for example, comprise an inflatable platform having a circular perimeter 1050. Alternate embodiments comprising inflatable platforms 1000 having alternate perimetral shapes are within the spirit and scope of the present invention. Inflatable platforms having perimetral forms which are regular polygons, equilateral polygons, and equiangular polygons are within the spirit and scope of the present invention. Furthermore, irregular shapes and irregular polygonal shapes are within the spirit and scope of the present invention.

Figure 2A:
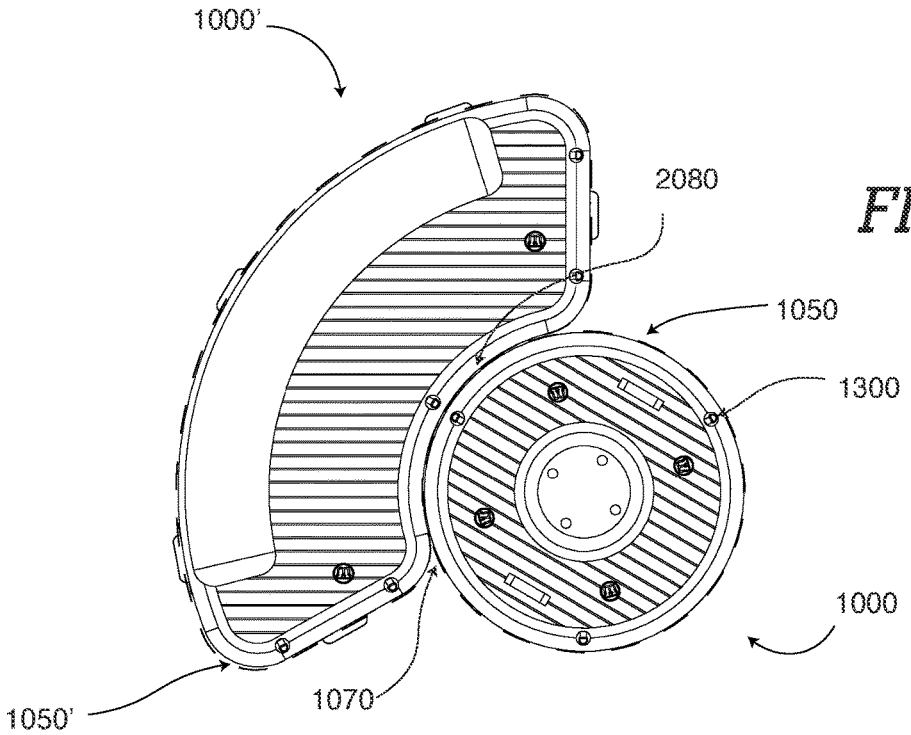

In certain embodiments, as shown in FIG. 2A for example, the interconnection of a first inflatable platform 1000 with a second inflatable platform 1000' results in continuous contact between a portion of the perimeter 1050 of the first inflatable platform and a portion of the perimeter 1050' of the second inflatable platform.

Figure 2B:
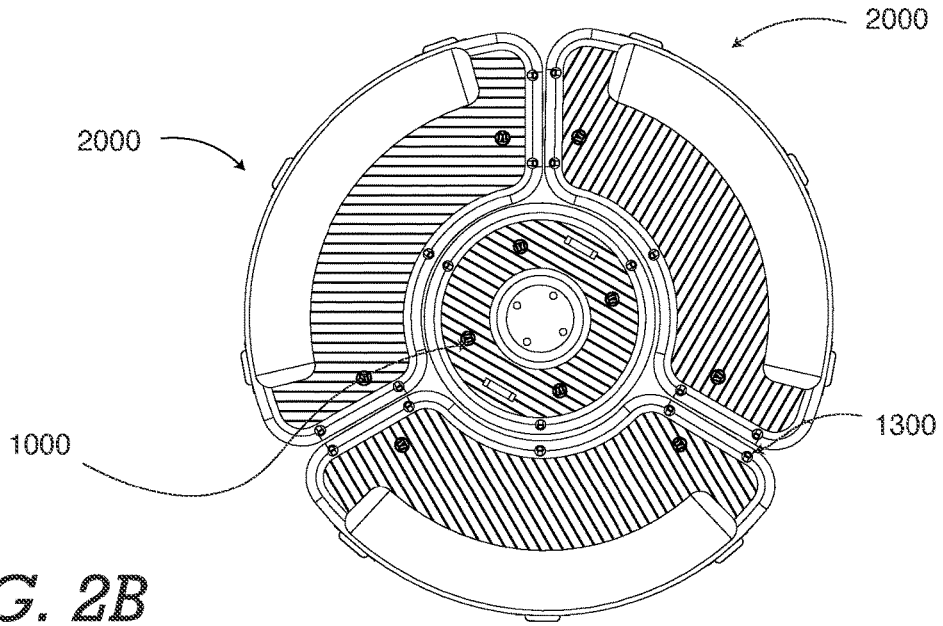
Figure 3A:
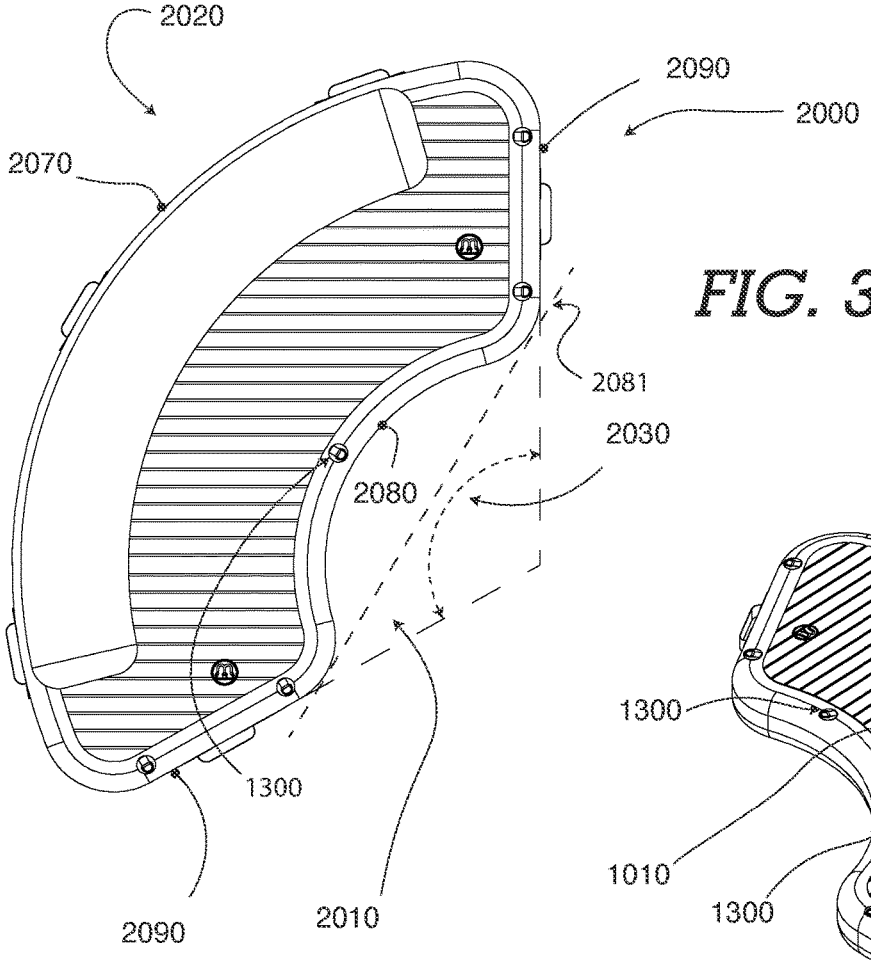
Figure 3C:
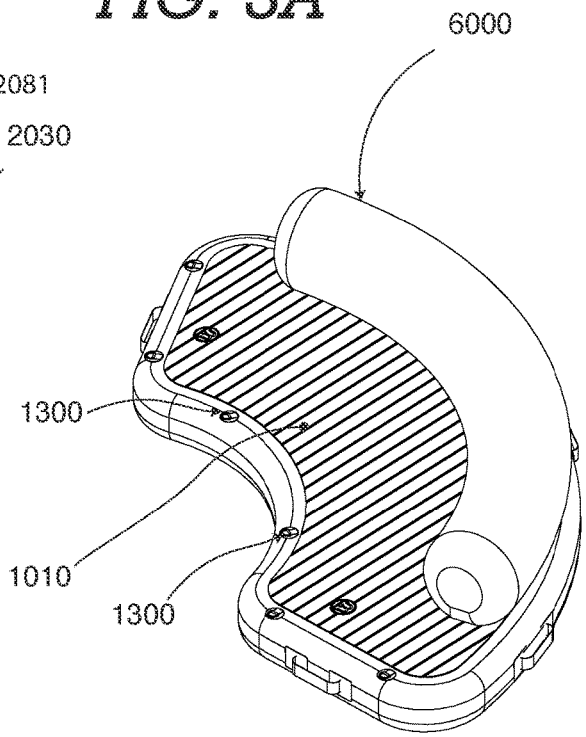
Figure 3B:
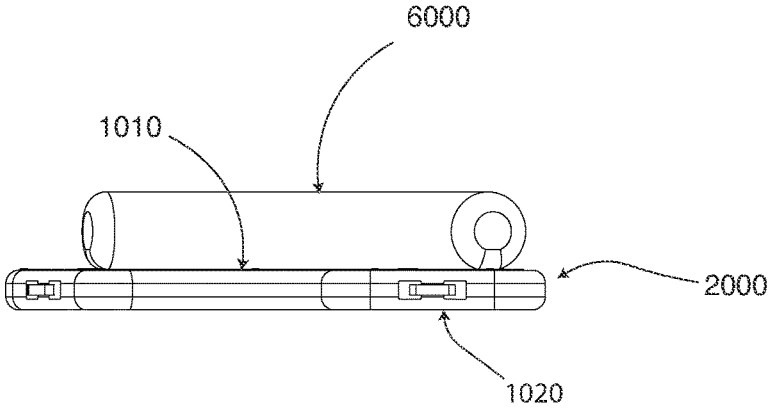

Certain embodiments of the present invention, as shown in FIG. 3A-FIG. 3B for example, comprise an arced shaped inflatable platform 2000 wherein a first side 2010 of the perimeter of the inflatable platform comprises an internal perimetral aspect 2080. Although a first side 2010 comprising a constant radius arc is shown, embodiments comprising an internal perimetral aspect 2080 having a polygonal or variable radius arc shape are within the spirit and scope of the present invention. In certain embodiments, as shown in FIG. 2A-FIG. 2B, a portion of the perimeter 1050 of a first inflatable platform 1000 is configured to be received by and interconnect with a second inflatable platform 1000' having an internal perimetral aspect 2080. The perimeter 1050 of the first inflatable platform comprises an external perimetral aspect 1070.

Certain embodiments of the present invention comprise an arced inflatable platform 2000 having an arced internal perimetral aspect 2080, an arced external perimetral aspect 2070, and linear aspects 2090 extending therebetween. In certain embodiments, as shown, the linear aspects 2090 are orthogonal to the internal perimetral aspect 2080 and the external perimetral aspect 2070. The arced internal perimetral aspect 2080 is configured to interconnect with a circular inflatable platform 1000 (as shown in FIG. 2A-FIG. 2B) resulting in substantially continuous contact between the internal perimetral aspect 2080 of the arced inflatable platform and a portion of the perimeter 1050 of the circular inflatable platform. It will be appreciated that the drop-stitch construction of the inflatable platforms will result in shapes that are imperfect such that there may be small gaps between interconnected inflatable platforms, but that the two inflatable platforms will be in substantially continuous contact along the internal and external perimetral aspects.

Figure 5A:
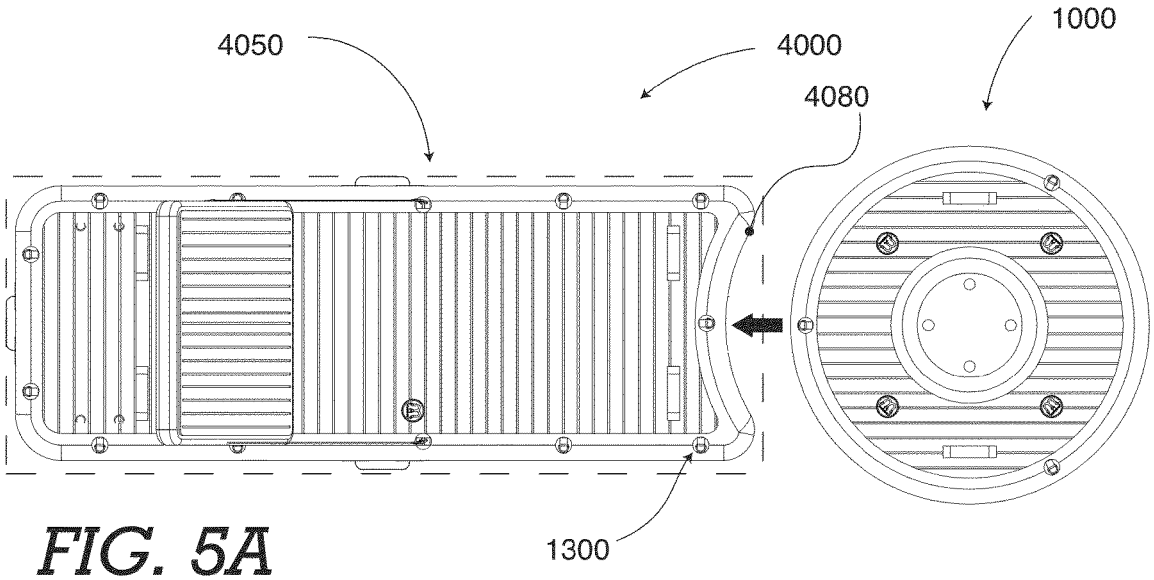

In certain embodiments the arced inflatable platform 2000 comprises an internal perimetral aspect 2080 having an arc-angle which is a mathematical factor of 360 degrees, wherein a plurality of arced inflatable platforms 2000 are configured to fully surround the circular inflatable platform 1000. In certain embodiments, as shown in FIGS. 2A, 3A and 5A, at least one interconnection point 1300 is interconnected to the inflatable platform within the chord 2081 of the internal perimetral aspect 2080. In a preferred embodiment, the interconnection point 1300 is interconnected to a first inflatable platform 1000 at the apex of the external perimetral aspect 1070 of the first inflatable platform 1000, and a corresponding interconnection point 1300 is interconnected to a second inflatable platform 1000' at the apex of the nesting internal perimetral aspect 2080. A deviation from the exact apex is acceptable so long as the interconnection points 1300 are within about 5 to 10 degrees or about 6 to 12 inches from the precise apex location. A deviation from the exact apex is acceptable so long as the interconnection points 1300 are within about 5 to 10 degrees or about 6 to 12 inches from the precise apex location. In an alternative embodiment, as shown in FIGS. 3A and 3C, at least two interconnection points 1300 are interconnected to the second inflatable platform within the chord 2081 of the internal perimetral aspect 2080. A first inflatable platform would have corresponding interconnection points along the external perimetral aspect.

In certain embodiments, as shown in FIG. 2A-FIG. 3C for example, an arced inflatable platform 2000 comprises an internal perimetral aspect 2080 having an arc-angle 2030 of about 120 degrees wherein the second inflatable platform 2000 is configured to interconnect with a first circular inflatable platform 1000, wherein three second inflatable platforms interconnected with the first circular inflatable platform 1000 will result in fully surrounding the circular inflatable platform.

As will be appreciated, the second inflatable platforms may have arc-angles that are mathematical factors of 360 degrees that, when interconnected together, would form a surrounding inflatable platform encircling a first inflatable platform. For example, and without limitation: a second inflatable platform having an arc-angle of about 270 degrees and a second inflatable platform having an arc-angle of about 90 degrees; two second inflatable platforms each having an arc-angle of about 180 degrees; three second inflatable platforms each having an arc-angle of about 120 degrees; four second inflatable platforms each having an arc-angle of about 90 degrees; a second inflatable platform having an arc-angle of about 180 degrees and two second inflatable platforms each having an arc-angle of about 90 degrees; a second inflatable platform having an arc-angle of about 240 degrees and a second inflatable platform having an arc-angle of about 120 degrees; or a single second inflatable platform having an arc-angle of about 360 degrees. As will also be appreciated, the first inflatable platform and the encircling second inflatable platform(s) may have other shapes beside the arcuate shapes shown in FIG. 2A-FIG. 3C. Additionally, the precise arc-angle of the second inflatable platform may be somewhat more or less than a standard mathematical factor of 360 degrees due to manufacturing tolerances or intentional design decisions. For example, a second inflatable platform having an arc-angle of about 120 degrees may be manufactured having an actual measured arc-angle that is about 1 to 5 degrees less than 120 degrees, resulting in some play in the fitting of the second inflatable platforms around the first inflatable platform. These tolerances ensure that the sum of arc-angles of the encircling second inflatable platforms will not exceed 360 degrees while maintaining close interconnections that will tend to prevent the arm or leg of a user from slipping through the interconnection between two inflatable platforms.

As will also be appreciated, the second inflatable platform or platforms need not entirely encircle the first inflatable platform. For example, as shown in FIG. 5A, the circular inflatable platform 1000 may be interconnected to and only partially encircled by a second inflatable platform 4000. Or additional second inflatable platforms 4000 may be interconnected to the circular inflatable platform 1000 to partially or fully surround the circular inflatable platform 1000.

Figure 4A:
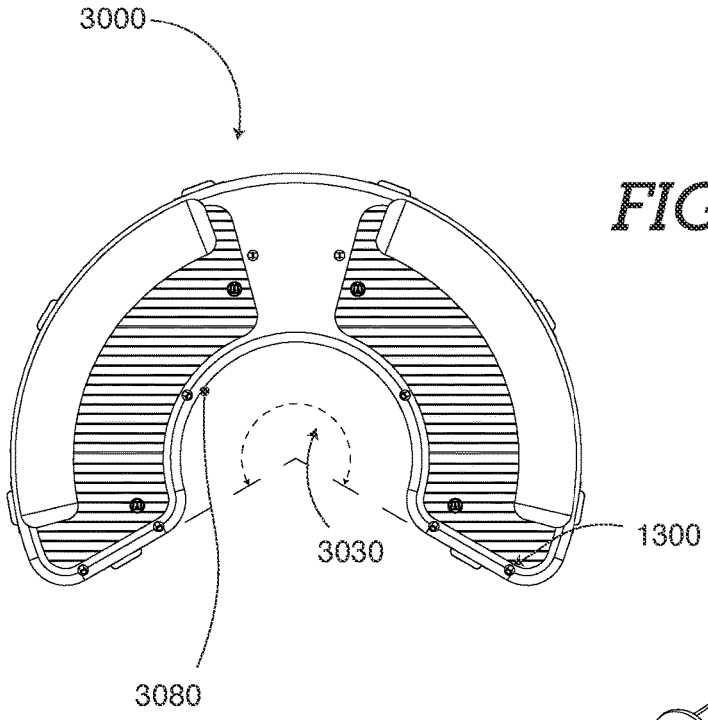
Figure 4C:
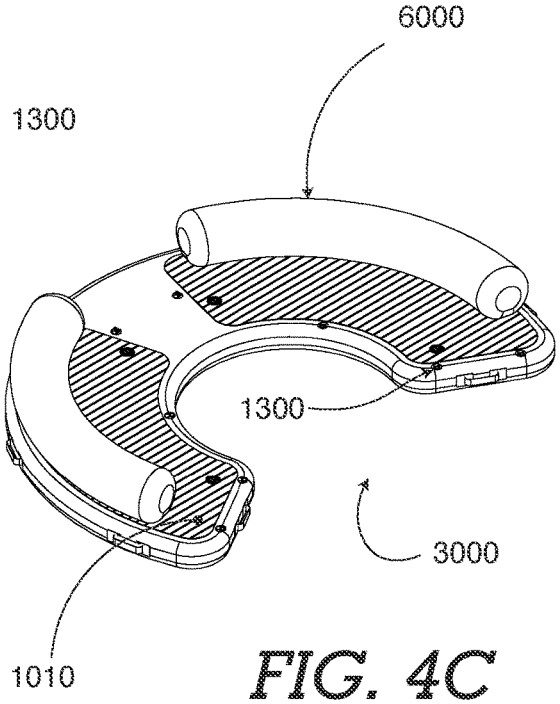
Figure 4B:
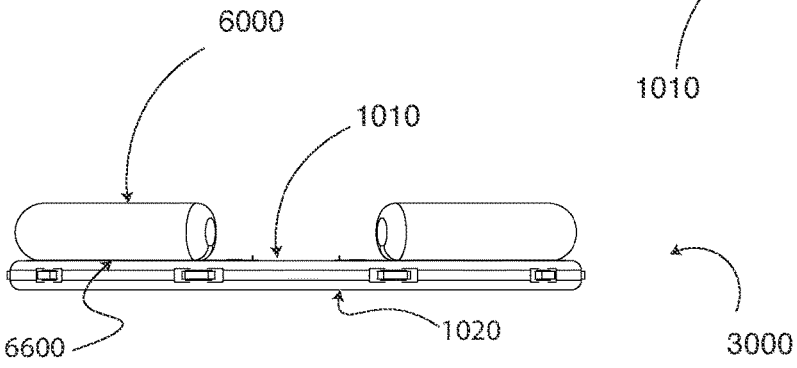

In certain embodiments, as shown in FIG. 4A-FIG. 4C for example, an arced inflatable platform 3000 comprises an internal perimetral aspect 3080 having an arc-angle of less than 360 degrees. In certain embodiments, an arced inflatable platform comprises an internal perimetral aspect having an arc-angle 3030 of 240 degrees. Accordingly, an arced inflatable platform 3000 having an internal perimetral aspect having an arc-angle of 240 degrees, and an arced inflatable platform 2000 (FIG. 3A-FIG. 3C) having an arc-angle 2030 of 120 degrees interconnected with a circular inflatable platform 1000 results in fully surrounding the circular inflatable platform 1000. It will also be appreciated that the arced inflatable platform 3000 having an internal perimetral aspect having an arc-angle of 240 degrees would encircle a circular first inflatable platform 1000 to a degree sufficient to encapsulate the first inflatable platform 1000 and help prevent it from disengaging with the arced inflatable platform 3000 in a lateral direction, even when the two platforms are not interconnected using the interconnection points 1300.

Figure 5C:
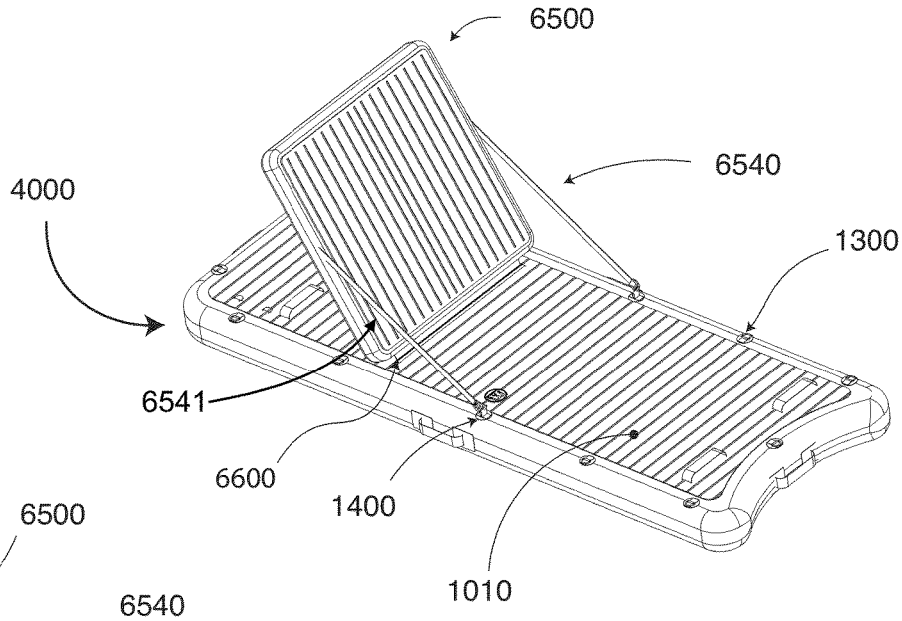
Figure 5B:
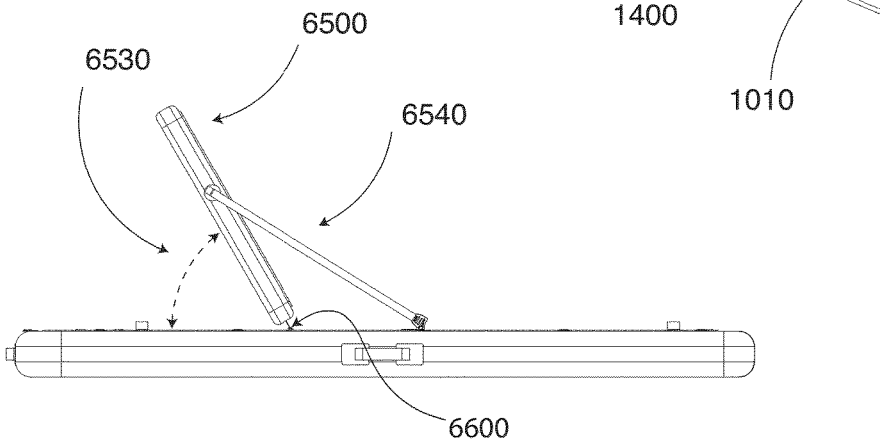

In certain embodiments, as shown in FIG. 5A-FIG. 5C, an inflatable platform 4000 comprises a rectangular shape 4050. In certain embodiments a rectangular inflatable platform comprises a side with an internal perimetral aspect 4080. For instance, as shown, the side of certain embodiments comprises a concave form configured to interconnect with an inflatable platform having an external perimetral aspect. For instance, the internal perimetral aspect 4080 as shown is configured to interconnect with a circular inflatable platform 1000 resulting in substantially continuous contact between the rectangular inflatable platform 4000 and the circular inflatable platform 1000.

Figure 6A:
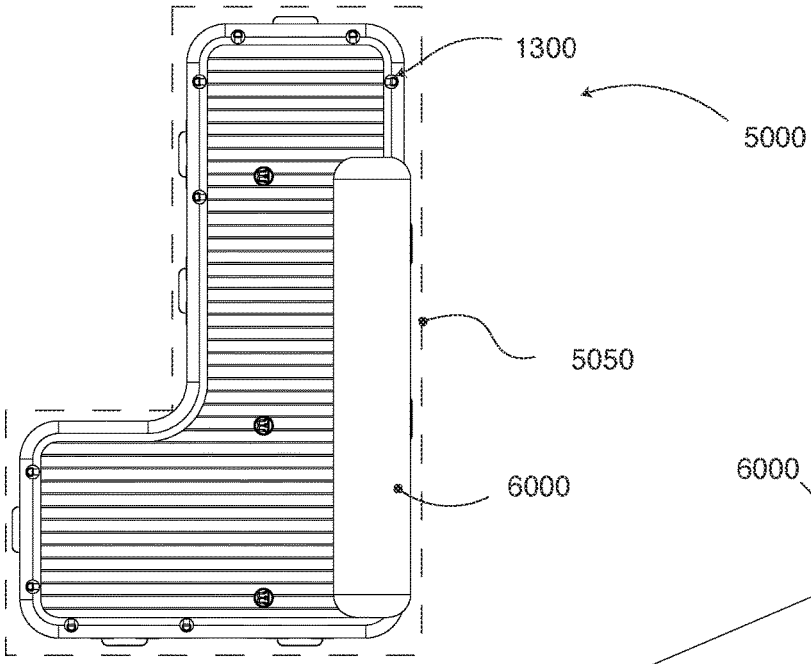
Figure 6C:
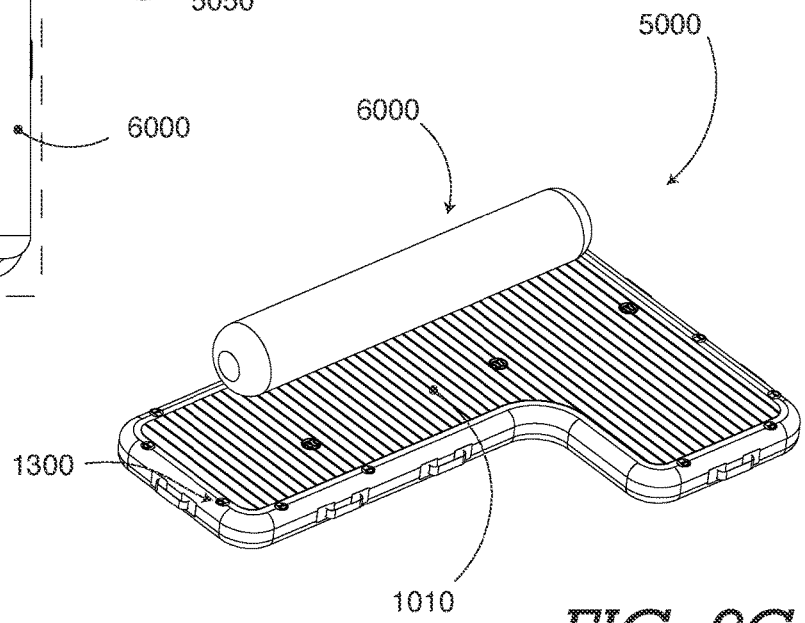
Figure 6B:
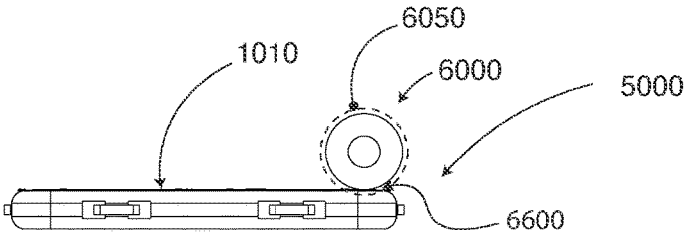
Figure 7A:
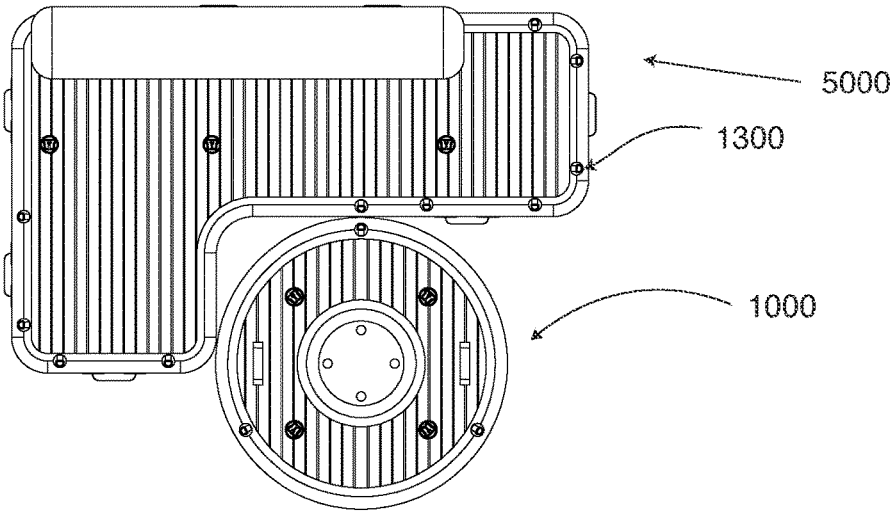
Figure 7B:
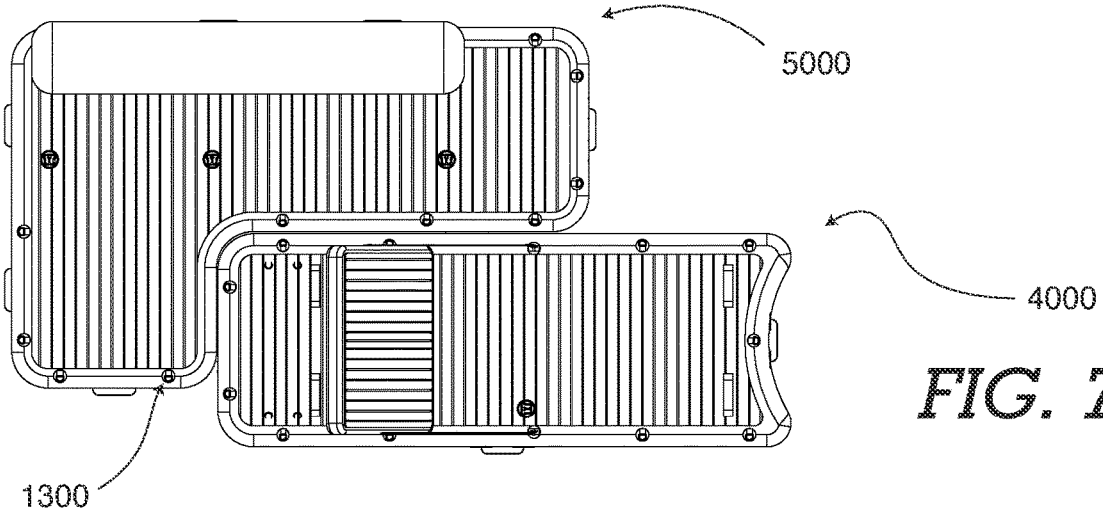
Figure 7C:
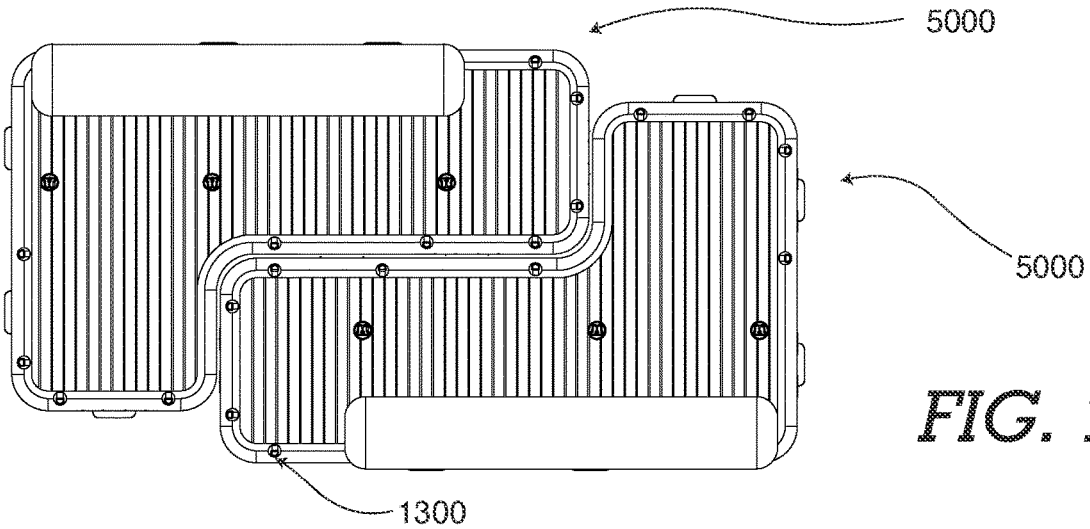

In certain embodiments of the present invention, shown in FIG. 6A-FIG. 6C for example, an inflatable platform 5000 comprises internal and external perimetral aspects in the form of an L-shaped perimeter 5050. In certain embodiments such as shown in FIG. 7A, the interconnection of an L-shaped internal perimetral aspect of inflatable platform 5000 with the external perimetral aspect of second inflatable platform, such as a circular inflatable platform 1000, results in two points of contact between the inflatable platforms. In alternate embodiments such as shown in FIG. 7B, the interconnection of an L-shaped internal perimetral aspect of inflatable platform 5000 with the external perimetral aspect of second inflatable platform, such as a rectangular inflatable platform 4000, results in the L-shaped inflatable platform 5000 having at least one side with substantially continuous contact with the second inflatable platform. In certain embodiments such as shown in FIG. 7B, an L-shaped inflatable platform 5000 is interconnected with a rectangular shaped inflatable platform 4000 wherein the L-shaped inflatable platform 5000 has substantially continuous contact with two sides of the rectangular shaped inflatable platform 4000. In further embodiments, such as shown in FIG. 7C, a first L-shaped inflatable platform 5000 is interconnected with a second L-shaped inflatable platform 5000 wherein the L-shaped inflatable platforms have 3 sides with substantially continuous contact. As shown in FIG. 7A-7C, the inflatable platforms may be interconnected using one or more interconnection points 1300.

In certain embodiments, such as shown in FIG. 6A-FIG. 6C, an inflatable platform comprises an inflatable bolster 6000 having a circular cross-section 6050. The bolster 6000 is configured to interconnect with a top surface 1010 of the inflatable platform. In certain embodiments the bolster 6000 comprises a linear form, while alternative embodiments comprises an arced form such as shown in FIG. 3A-FIG. 4C. In certain embodiments, the bolster 6000 is interconnect with a top surface 1010 by a rail and track 6600 such as shown and described by FIG. 6 of the '337 application.

In certain embodiments, as shown in FIG. 5A-FIG. 5C, an inflatable platform comprises an inflatable backrest 6500 configured to interconnect with a top surface 1010 of an inflatable platform wherein the backrest 6500 is configured to be hingedly affixed to the top surface of the inflatable platform, allowing the angle 6530 between the backrest 6500 and the top surface 1010 of the inflatable platform to be adjusted between 0 degrees and 180 degrees. In certain embodiments the backrest 6500 is fixed in the desired position using a first tether 6540 and a second tether 6541 which interconnect with interconnection points 1400 interconnected with the inflatable platform 4000. In certain embodiments, the backrest 6500 is hingedly affixed to the top surface of the inflatable platform by a rail and track 6600 such as shown and described by FIG. 6 of the '337 application.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed:

1. An inflatable platform system comprising:

a first planar inflatable platform having a top surface, a bottom surface, and a perimeter;

wherein the first inflatable platform comprises a first external perimetral aspect adapted to nest with an internal perimetral aspect of a second planar inflatable platform;

wherein the external perimetral aspect comprises an interconnection point adapted to interconnect with an interconnection point of the internal perimetral aspect of a second planar inflatable platform;

wherein the first inflatable platform comprises a recess extending through the top surface of the first inflatable platform, the recess comprising a bottom surface; and wherein the bottom surface of the recess comprises a membrane interconnected to the bottom surface of the inflatable platform.

2. The inflatable platform system of claim 1, wherein the first external perimetral aspect comprises an arcuate shape.

3. The inflatable platform system of claim 1, wherein the first external perimetral aspect comprises a polygonal shape.

4. The inflatable platform system of claim 1, wherein the top surface of the first inflatable platform comprises at least one magnetic connection adapted to interconnect with drinkware.

5. The inflatable platform system of claim 1 further comprising:

a second planar inflatable platform;

wherein the second inflatable platform comprises an internal perimetral aspect adapted to nest to the first external perimetral aspect of the first inflatable platform; and wherein the internal perimetral aspect comprises an interconnection point adapted to interconnect with the interconnection point of the first external perimetral aspect.

6. The inflatable platform system of claim 5, wherein the interconnection point of the external perimetral aspect is interconnected to the top surface of the first inflatable platform, and wherein the interconnection point of the internal perimetral aspect is interconnected to the top surface of the second inflatable platform.

7. The inflatable platform system of claim 5, wherein the internal perimetral aspect has substantially the same shape as the external perimetral aspect.

8. The inflatable platform system of claim 7, wherein the internal perimetral aspect and external perimetral aspect comprise an arcuate shape.

9. The inflatable platform system of claim 7, wherein the internal perimetral aspect and external perimetral aspect comprise an L-shape.

10. The inflatable platform system of claim 5, wherein the top surface of the second inflatable platform comprises at least one magnetic connection adapted to interconnect with drinkware.

11. The inflatable platform system of claim 5, wherein the internal perimetral aspect comprises an arc-angle which is a mathematical factor of 360.

12. The inflatable platform system of claim 5, wherein the internal perimetral aspect comprises an arc-angle, and wherein the arc-angle comprises one of about 90 degrees, about 120 degrees, about 180 degrees, about 240 degrees, or about 270 degrees.

13. The inflatable platform system of claim 5, further comprising:

a third planar inflatable platform;

wherein the first inflatable platform comprises a second external perimetral aspect;

wherein the second external perimetral aspect comprises an interconnection point adapted to interconnect with an interconnection point of an internal perimetral aspect of the third planar inflatable platform;

wherein the internal perimetral aspect of the third planar inflatable platform is adapted to nest to the second external perimetral aspect of the first inflatable platform; and wherein the internal perimetral aspect of the third planar inflatable platform comprises an interconnection point adapted to interconnect with the interconnection point of the second external perimetral aspect.

14. The inflatable platform system of claim 5, wherein the second inflatable platform comprises a backrest hingedly interconnected to a top surface of the second inflatable platform.

* * * * *